US005666702A

United States Patent [19]

Ming-Chieh

[11] Patent Number: 5,666,702

[45] Date of Patent: Sep. 16, 1997

[54] HELICAL TORSION SPRING WITH AN ATTACHED CLIP

[76] Inventor: Chen Ming-Chieh, No. 25, Mingte st., Lin 2, P'u-Lun Li, Lu-Kang Town, Chang-Hua Hsien, Taiwan

[21] Appl. No.: 657,693

[22] Filed: May 31, 1996

[51] Int. Cl.[6] ..... A44B 21/00

[52] U.S. Cl. ..... 24/510; 24/67.7; 24/338; 24/563

[58] Field of Search ..... 24/510, 338, 3.11, 24/312, 11 P, 11 R, 11 CC

[56] References Cited

U.S. PATENT DOCUMENTS

| | | | |
|---|---|---|---|
| 1,644,948 | 10/1927 | Poirier | 24/563 |
| 2,189,715 | 2/1940 | Hoiseth | 24/11 CC |
| 2,455,258 | 11/1948 | Levitin | 24/338 |
| 2,519,987 | 8/1950 | Wernette | 24/563 |
| 3,203,061 | 8/1965 | Thomas | 24/338 |
| 3,246,914 | 4/1966 | Goodwin | 24/67.7 |
| 4,506,416 | 3/1985 | Ohminato et al. | 24/545 |
| 4,959,892 | 10/1990 | Wang | 24/510 |
| 5,058,242 | 10/1991 | Liu et al. | 24/67.7 |

FOREIGN PATENT DOCUMENTS

| | | | |
|---|---|---|---|
| 1127231 | 12/1956 | France | 24/338 |

*Primary Examiner*—Victor N. Sakran
*Attorney, Agent, or Firm*—W. Wayne Liauh

[57] ABSTRACT

An improved helical torsion spring is disclosed which contains an integrally attached clip. The improved helical torsion contains: (a) a helical torsion spring having a coiled portion and front and end non-coiled portions; (b) a clip having a transverse opening for sleeving about the coiled portion of the helical torsion spring, and a concave slot for receiving a slim-bodied object. The transverse opening of the clip has a section-section smaller than a length of either of the front or end non-coiled portion so as to retain the clip therebetween. The improved helical torsion spring can be used in essentially the same a conventional torsion spring can be used; however, it provides the advantage of being able to carry a slim-bodied object such as pencils, pens, or other similar goods.

3 Claims, 6 Drawing Sheets

HELICAL TORSION SPRING WITH AN ATTACHED CLIP

BACKGROUND OF THE INVENTION

1. Field of the Invention

This invention relates to a helical torsion spring with an attached clip and particularly to a helical torsion spring with an attached clip which can be used on a clamping apparatus.

2. Description of the Prior Art

In an usually busy working day in the office or shop floor, people sometimes are troubled by not being able to find needed stationaries or hand tools such as a pencil, a pen or a screwdriver. Trying to find these items often wastes time and decreases efficiency. There is always room for improvement in this regard.

SUMMARY OF THE INVENTION

It is therefore an object of the present invention to provide a helical torsion spring with an attached clip which can be used on a conventional clamping apparatus for holding goods with a slim body such as a pen, pencil or screwdriver. The goods thus may be carried to wherever the clamping apparatus is located and is readily available for use.

It is another object of the invention to provide a helical torsion spring with an attached clip which can be easily adopted to various types of conventional clamping apparatus without changing the structure or occupying the axle space thereof.

DETAILED DESCRIPTION

Figure 1:
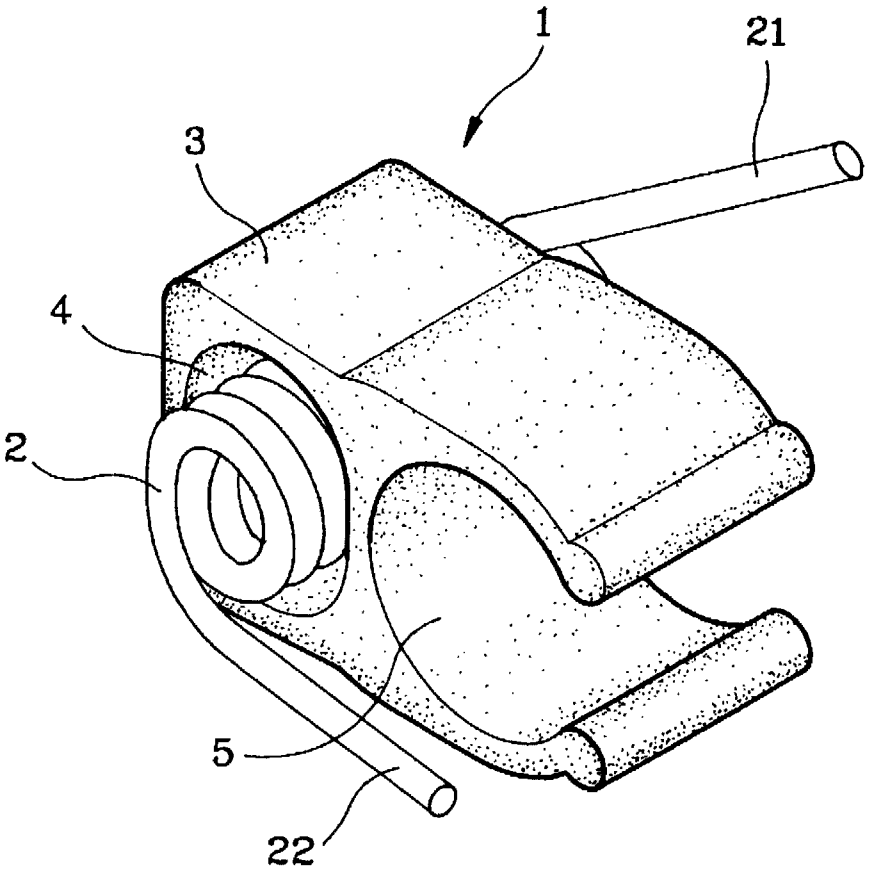
FIG. 1 is a perspective view of an embodiment of the present invention.

Referring to FIG. 1, which describes an embodiment of the present invention 1, it includes mainly a helical torsion spring 2 and a clip 3. The spring 2 is housed in a transverse opening 4 formed in the rear portion of the clip 3. The clip 3 has a concave slot 5 formed in the front portion. The size of the concave slot 5 is about the same size of the casing of a conventional pen, pencil or the shank of a screwdriver. Therefore the pen, pencil or screwdriver may be held in the clip for ready use. The helical torsion spring 12 contains two elongated end portions 21 and 22. The transverse opening 4 formed in the rear portion of the clip 3 has a cross-section that is smaller than the lengths of the elongated portions 21 and 22, so as to cause the clip 3 to be retained between the elongated portions 21 and 22.

Figure 2:
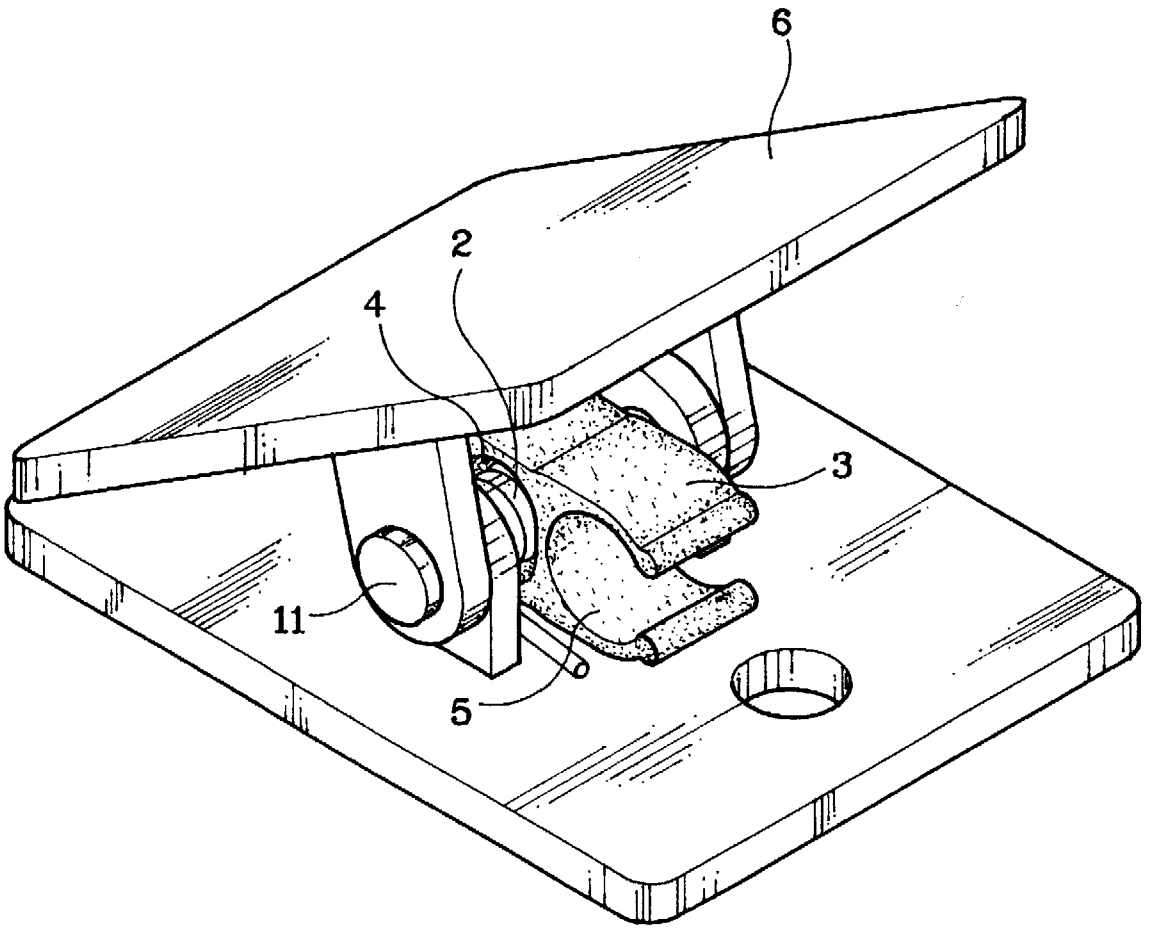
FIG. 2 is a pictorial view showing the present invention being adopted to a clamping apparatus.
Figure 3:
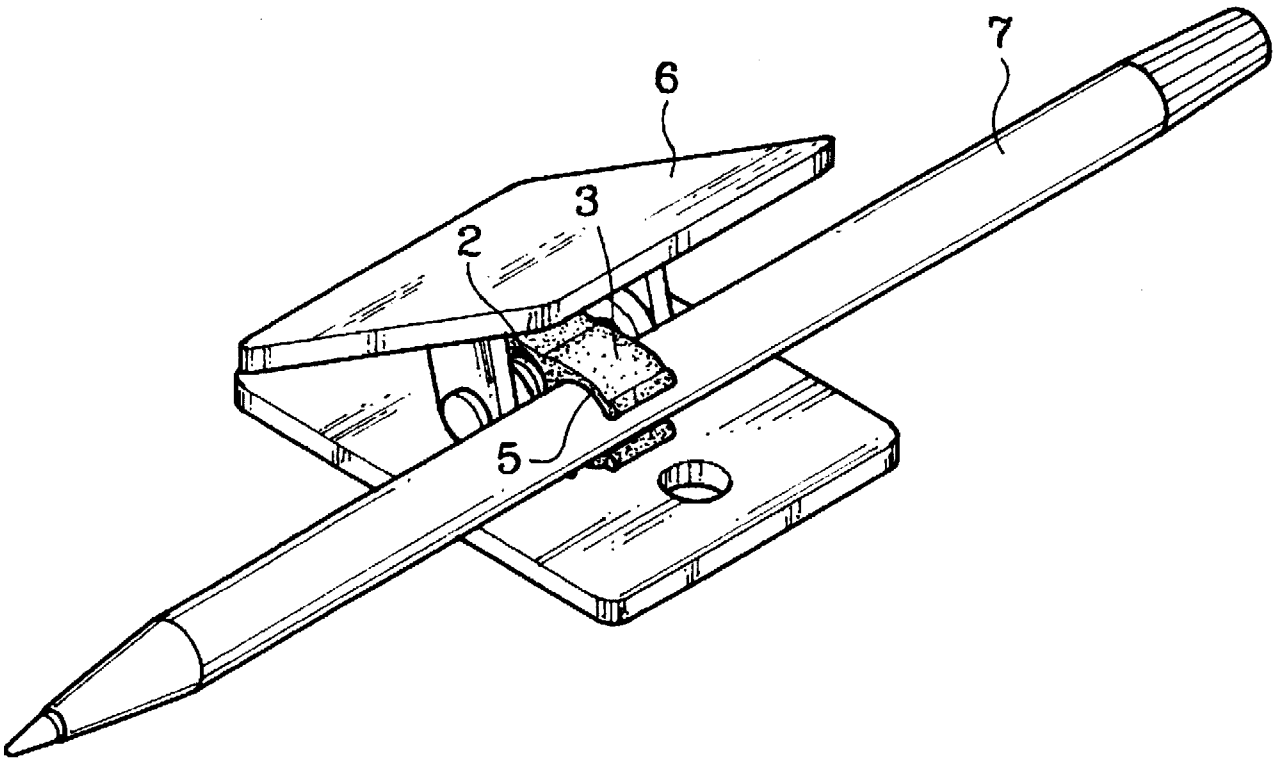
FIG. 3 is a pictorial view according to FIG. 2 with the present invention holding a pen.

FIGS. 2 and 3 show two example applications of the invention being used on a conventional clamping apparatus

6. It can be located at the same position as a conventional helical torsion spring would be located, and has the same amount of torsional force to hold the goods intended. A pen 7 or other similar tools may be securely held in the concave slot 5 and can be easily taken out whenever needed. The pen or tool can travel with the clamping apparatus 6 wherever it is required. A user can readily find and use the tool when there is a need. This invention may be used on various conventional clamping apparatus without changing the length or structure of the axle of the clamping apparatus.

Figure 4:
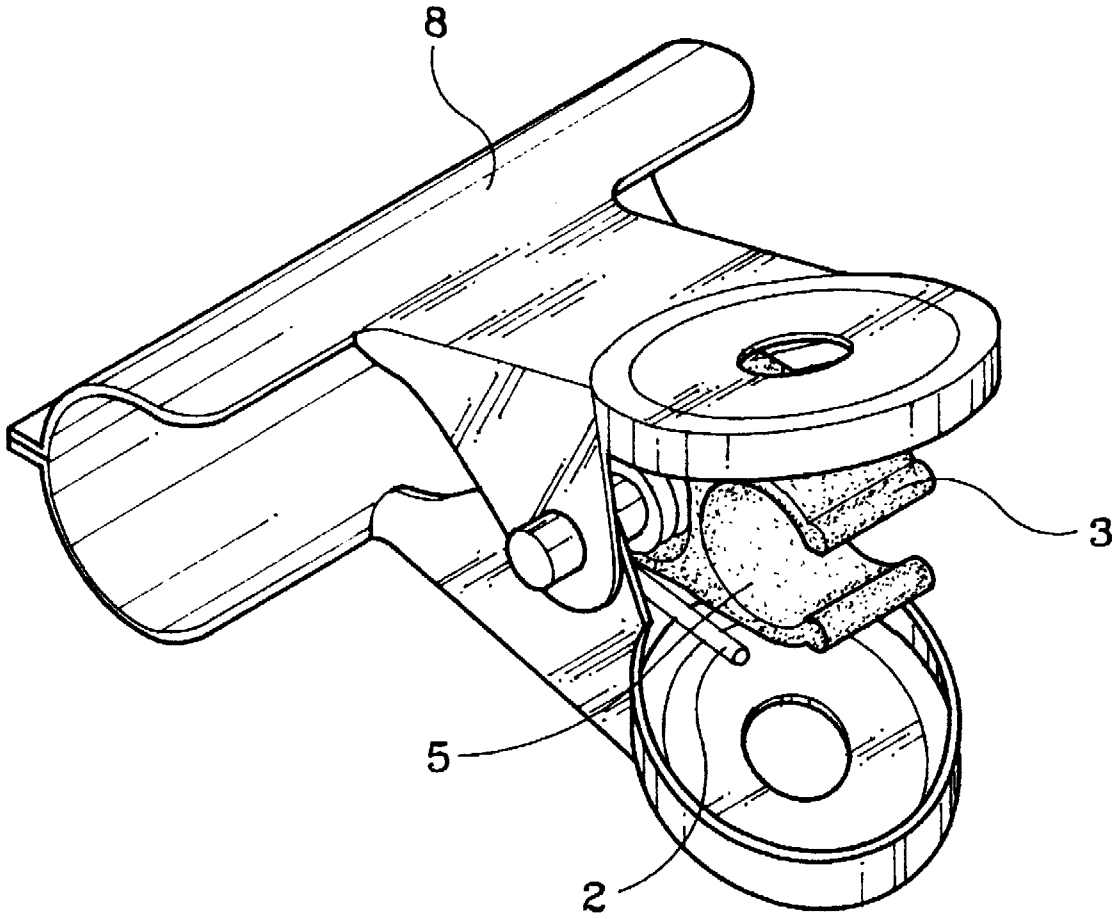
FIG. 4 is a pictorial view of the present invention being adopted to another type of clamping apparatus.

FIG. 4 illustrates the present invention being adopted to another type of conventional clamping apparatus 8.

Figure 5:
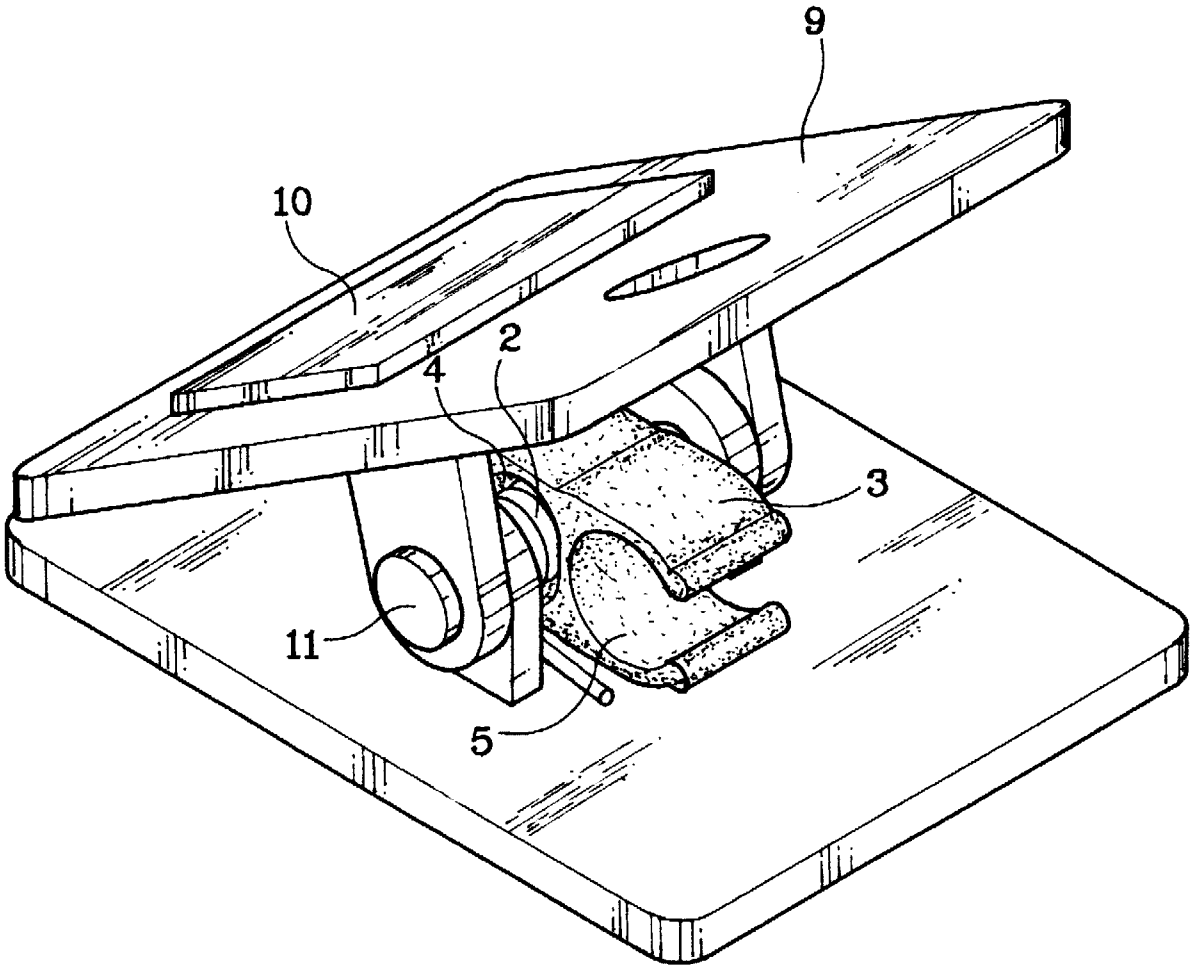
FIG. 5 is a pictorial view of the present invention being adopted to yet another type of clamping apparatus.

FIG. 5 illustrates the present invention being adopted to yet another type of clamping apparatus 9 which may include a magnet 10. The clamping apparatus may be attached to any goods which can be attracted to a magnet such as the door of a refrigerator to enable a user to take note easily.

Figure 6:
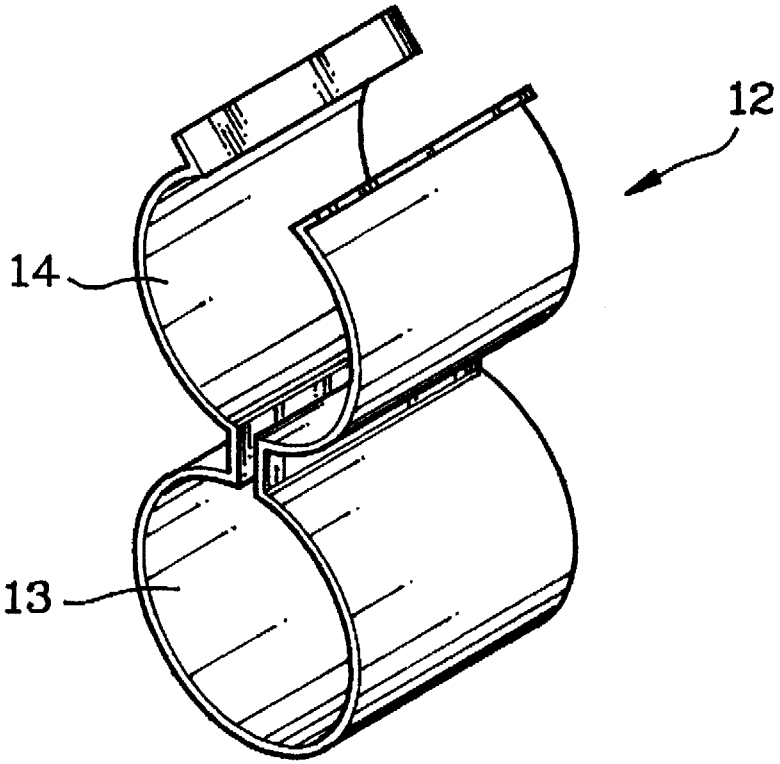
FIG. 6 is a perspective view of another embodiment of the present invention.

FIG. 6 depicts another embodiment of the present invention. The clip 12 is formed by a steel strip which has a transverse opening 13 for housing a helical spring and a concave slot 14 for holding a pen or a tool with a slim body.

The clip may be made of steel, brass, aluminum, plastics, rubber or other suitable materials.

It is to be understood that the description and preferred embodiments set forth above are only to serve for illustrative purpose, and do not intent to limit the scope of the present invention. Various changes and modifications may be made without departing from the scope of the present invention. Accordingly, the specific scope of the present invention is defined only by the following claims which are further exemplary of the present invention.

I claim:

1. A helical torsion spring with an attached clip, comprising:

a helical torsion spring having a coiled portion and front and end non-coiled portions;

a clip having a transverse opening for sleeving about said coiled portion of said helical torsion spring, and a concave slot for receiving a slim-bodied object;

wherein said transverse opening of said clip has a section-section smaller than a length of either of said front or end non-coiled portion so as to retain said clip therebetween.

2. The helical torsion spring with an attached clip of claim 1, wherein the clip is made of a material selected from the group consisting of steel, brass, aluminum, plastic, rubber and combinations thereof.

3. A clamping device containing a clamp and a helical torsion spring with an integrally associated clip, wherein said helical torsion spring with said integrally associated clip comprises:

a helical torsion spring having a coiled portion and front and end non-coiled portions;

a clip having a transverse opening for sleeving about said coiled portion of said helical torsion spring, and a concave slot for receiving a slim-bodied object;

wherein said transverse opening of said clip has a section-section smaller than a length of either of said front or end non-coiled portion so as to retain said clip therebetween.

* * * * *